US007435233B2

(12) United States Patent
Baldauf et al.

(10) Patent No.: US 7,435,233 B2
(45) Date of Patent: Oct. 14, 2008

(54) APPARATUS FOR MECHANICALLY VENTILATING A PATIENT

(75) Inventors: Mary Baldauf, Valley Stream, NY (US); Thomas Baldauf, Merrick, NY (US)

(73) Assignee: Baldy By Design, LLC, Valley Stream, NY (US)

( * ) Notice: Subject to any disclaimer, the term of this patent is extended or adjusted under 35 U.S.C. 154(b) by 620 days.

(21) Appl. No.: 10/854,957

(22) Filed: May 27, 2004

(65) Prior Publication Data

US 2005/0267387 A1 Dec. 1, 2005

(51) Int. Cl.
*A61H 31/00* (2006.01)
*A61H 31/02* (2006.01)

(52) U.S. Cl. ..... 601/9; 601/11; 601/41; 601/44; 601/DIG. 6

(58) Field of Classification Search ..... 601/41, 601/43, 44, 6, 7, 9, 10, 11; 600/21; 128/202.12, 128/205.26

See application file for complete search history.

(56) References Cited

U.S. PATENT DOCUMENTS

| | | | | |
|---|---|---|---|---|
| 1,175,671 | A * | 3/1916 | Acklen | 601/44 |
| 2,309,361 | A | 1/1943 | Terhaar | |
| 2,508,846 | A * | 5/1950 | Wallin | 601/43 |
| 3,078,842 | A | 2/1963 | Gray | |
| 3,862,622 | A | 1/1975 | Spinnett | |
| 4,038,806 | A | 8/1977 | Rothman et al. | |
| 4,257,407 | A | 3/1981 | Macchi | |
| 4,294,464 | A | 10/1981 | Ettridge | |
| 4,761,853 | A | 8/1988 | Hoffman | |
| 5,222,478 | A | 6/1993 | Scarberry et al. | |
| 5,261,779 | A | 11/1993 | Goodrich | |
| 5,490,820 | A | 2/1996 | Schock et al. | |
| 5,573,498 | A | 11/1996 | Hayek | |
| 6,461,315 | B1 | 10/2002 | Gattinoni | |
| 6,497,231 | B1 | 12/2002 | White | |
| 2004/0030272 | A1 | 2/2004 | Kelly et al. | |
| 2004/0079506 | A1 | 4/2004 | Mohrsen et al. | |

* cited by examiner

*Primary Examiner*—Danton DeMille
(74) *Attorney, Agent, or Firm*—Dilworth & Barrese LLP

(57) ABSTRACT

An apparatus for mechanically ventilating a patient is provided to have two separate components movably arranged with respect to one another within a flexible, air-tight covering fit about the torso of a patient. When the components move away from one another within the air-tight covering, negative pressure is generated which causes the patient to draw air into the lungs. Conversely, when the components stop moving away from one another within the air-tight covering, the patient's natural exhalation recoil takes over to allow the patient to expel the air from within the patient's lungs.

16 Claims, 8 Drawing Sheets

APPARATUS FOR MECHANICALLY VENTILATING A PATIENT

BACKGROUND OF THE INVENTION

The present invention is directed to a physical apparatus used to assist mechanically ventilating a patient. More specifically, the present invention provides non-invasive pressure changes outside a patient's chest wall, allowing mechanical ventilation without need for invasive endotracheal, orotracheal or tracheal intubation.

Under normal physiological conditions, humans breathe using "negative pressure ventilation." In other words, a negative intrathoracic pressure is created by contraction of the intercostal muscles (between the ribs), upward and outward expansion of the ribs, and downward movement of the muscular diaphragm separating the thorax from the abdomen. All these changes act to expand both lungs and thus create a negative intrathoracic pressure. The pressure change enables gas to move from the outside atmosphere, through the human air passages, and into the deepest areas of the human lung. The natural tendency of the lungs to constrict similarly to a stretched rubber band, (elastic recoil), creates an inward intrathoracic pull, such that, as soon as the intercostal muscles relax, the ribs are pulled inward and downward, and the muscular diaphragm is pulled upward. These movements create a positive intrathoracic pressure, relative to the outside atmospheric pressure, thus forcing the gas out of the lungs through the human air passages, and back into the atmosphere.

By drawing on the natural biomechanics of human breathing, the present invention very closely simulates human respiratory mechanics and aids neonatal, pediatric and adults patients who require respiratory support or assistance.

Many different machines have been designed to deliver gas into the lungs by creating positive pressure outside the airways, and thereby forcing gas into the patient's airways. These machines provide lifesaving benefit, but are not without risks. For example, most "positive pressure ventilators" force gas through a small, artificial tube placed within the patient's trachea or airway, termed "invasive positive pressure ventilation," because the patient's airway is penetrated or invaded by the artificial tube. Use of such a tube carries complications such as difficulty in proper placement, risks of dislodging, clogging, or causing infection. Additionally, the force with which each breath is delivered to the patient can lead to trauma to the lung tissue itself, including lung rupture or collapse.

More recently, "noninvasive positive pressure ventilation" has begun being practiced, which involves using a mask outside a patient's nose or mouth to deliver the positive pressure into the lungs. This greatly reduces the risks of improper placement, dislodging or clogging of the mask, and virtually eliminates the risk of severe infection due to contamination of equipment. However, such form of mechanical ventilation functions less than ideally because the gas cannot be directed solely into the lungs, but is rather forced into the back of the throat where the gas travels to both the lungs and stomach, the relative proportions of gas depending on the resistance of each pathway. Furthermore, several noninvasive negative pressure ventilators require the patient to remain confined to bed (e.g., the "iron lung"), while others might allow the patient to sit up or be pushed in a wheelchair, but do not permit full mobility.

Therefore, developing the ability to utilize "noninvasive negative pressure ventilation" can eliminate many of the risks of the positive pressure ventilators.

Accordingly, it is an object of the present invention to improve effective and safe use of noninvasive negative pressure ventilation in assisting mechanical ventilation of a patient.

It is a more particular object of the present invention to provide a self-contained, noninvasive negative pressure mechanical ventilator created in the form of an air-tight covering about a patient's torso that will permit full mobility and comfort of the patient.

It is a further object of the present invention to improve respiratory mechanics and mobility, and thereby improve quality of life of patients requiring mechanical ventilation.

SUMMARY OF THE INVENTION

These and other objects are attained by the present invention which is directed to an apparatus for mechanically ventilating a patient, comprising two separate, substantially rigid components structured and arranged to be movably coupled with respect to one another, and a flexible, air-tight covering (e.g., a vest) structured and arranged to cover both components when placed about a torso of a patient. When the components move away from one another within the air-tight covering, negative pressure is generated within the covering and causes the patient to draw air into the expanding lung cavity. The only active part of the vest is the creation of negative intrathoracic pressure by moving the front and back plates away from each other within the air-tight vest.

The mechanism that moves the plates away from each other will be timed such that it will release itself (for example, a pneumatic actuator is spring-loaded and has a one-way release valve to let go of the compressed air and thus allow the pin of the actuator to return and re-set itself for the next inhalation).

What causes the patient to exhale is the same mechanism by which every other person exhales, whether spontaneously breathing without a machine, invasive positive pressure breathing, or negative pressure breathing that is the natural elastic recoil of the lungs themselves.

Similar to stretching giant rubberbands, effort is only required to expand the lungs (to inhale); once the lungs stop expanding, then they will naturally recoil (thereby creating positive intrathoracic pressure and forcing air from inside the lungs and airways to outside the airways). Moving the plates closer to each other does not cause the patient to exhale, in and of itself.

The negative pressure ventilator vest allows the patient's own natural lung mechanics to control the exhalation (thus aiding the patient's respirations, while operating closely to mimic a patient's own natural, spontaneous respiratory efforts).

The one-way air-release valve(s) built into the air-tight vest allow for quick-release of any air trapped underneath the vest during inhalation (namely from the area around the neck of the vest, which cannot realistically be completely air impenetrable due to concerns of patient safety and comfort).

Exhalation due to elastic recoil occurs very quickly so trapped air underneath the vest should not impede this process (that is why the release valve(s) are placed in the material of the vest).

Preferably, means for movably coupling these components together are provided within the air-tight covering. This means can take the form of a pantograph linkage, a U or horseshoe, or a pincer. More particularly, the components are formed as two separate, light-weight, concave, rigid half-shells positioned on the front and back of a patient's torso, adjacent the chest cavity. Each component is positioned with the concave side toward the torso and held in place with soft straps placed across the patient's shoulders. Additional straps may be placed around the waist, if desired. These separate shells can be formed from any lightweight material that will maintain shape, e.g., fiberglass, plastic or plaster, and may be formed of several layers adhering together, e.g., as a laminate.

The straps can be formed from cotton, cloth, leather, or any other appropriate material, and can be fastened together with Velcro®, hooks or ties. Different size shells can easily be provided in accordance with the present invention.

About one to three pneumatic actuators will be attached to the anterior and posterior shells on each side of the patient, depending on desired negative pressure generation for each patient. These actuators are activated by a pneumatic system along the lateral edge of the outer covering or vest, thus eliminating the need for electrical or battery-generated power. The pneumatic actuators can be powered in any of the following ways. Firstly, compressed gas tubes can be provided with timed release-valves to periodically force the pin outwardly from the actuator. When the valve is cycled to the "off" position, the compressed gas is no longer directed to the actuator and the spring-loaded mechanism then pulls the pin of the actuator back inwardly. The air previously inside the barrel of the actuator is simultaneously released via a one-way valve built into the actuator. Alternatively, electrically and/or battery operated compressors that convert atmospheric gas into compressed gas and then time-cycle the compressed gas into the actuator in the same manner, could be used in the context of the present invention.

The air pressure, stroke length, and exerted force of the actuators are adjustable, allowing for operator control of the patient-specific ventilator breath rates, tidal volume generation, and inspiratory time. The stroke of the actuator will automatically adjust based on anterior and posterior resistance to movement, thus allowing the anterior and posterior shells to move equally when the patient is standing, and the non-dependent shell to move twice as far when the dependent shell is immobile, when the patient is lying down (either prone or supine).

The anterior and posterior shells, as well as the pneumatic actuators attached to the lateral edges, will all be covered by the air-tight, rubberized, short-sleeved shirt or covering, with tight fasteners around both sleeves and the waist area. The neck area will also be air-tight, but not fastened as tightly. The shirt or vest will have several one-way air-release valves that will contain air during expansion of the shells, yet allow for quick escape of air during the period of patient exhalation when the shells are moving toward each other.

The inventive vest will sit comparatively or substantially air-tightly about the upper torso of a patient. In other words, there will be some slight seepage of air into the vest through, e.g., the collar about a patient's neck. However, the one-way air release valve permits expelling of this seepage upon the patient's exhalation.

The actuators utilize pneumatic pressure to push apart the anterior and posterior shells from each other. When this operation is performed inside the rubberized, air-tight shirt, a negative pressure is generated within the shirt that, in turn, pulls the walls of the patient's chest upward and outward. This results in negative intrathoracic pressure, which then causes the patient to draw air from the higher pressure atmosphere into the lungs through the patient's airways. The actuators are set to allow time for the shells to come together during the natural "elastic recoil" phase of normal human exhalation. During this phase, the one-way valves allow air to exit from inside the air-tight covering, thereby readying the apparatus for the next inhalation cycle. Alternatively, the anterior and posterior components or shells can be movably coupled by a mechanism situated externally of the rubberized shirt or vest.

The inventive apparatus thereby simulates normal, physiologic breathing, eliminating the need for artificial airway maintenance and allowing each patient to achieve full mobility and thereby, normal existence.

BRIEF DESCRIPTION OF THE DRAWINGS

The present invention will be described in greater detail with reference to the accompanying drawings, in which:

FIG. 8 is a plan view, similar to FIGS. 3, 5 and 7 and illustrating a further alternative embodiment of the present invention.

DESCRIPTION OF THE PREFERRED EMBODIMENTS

Figures 1, 1A:
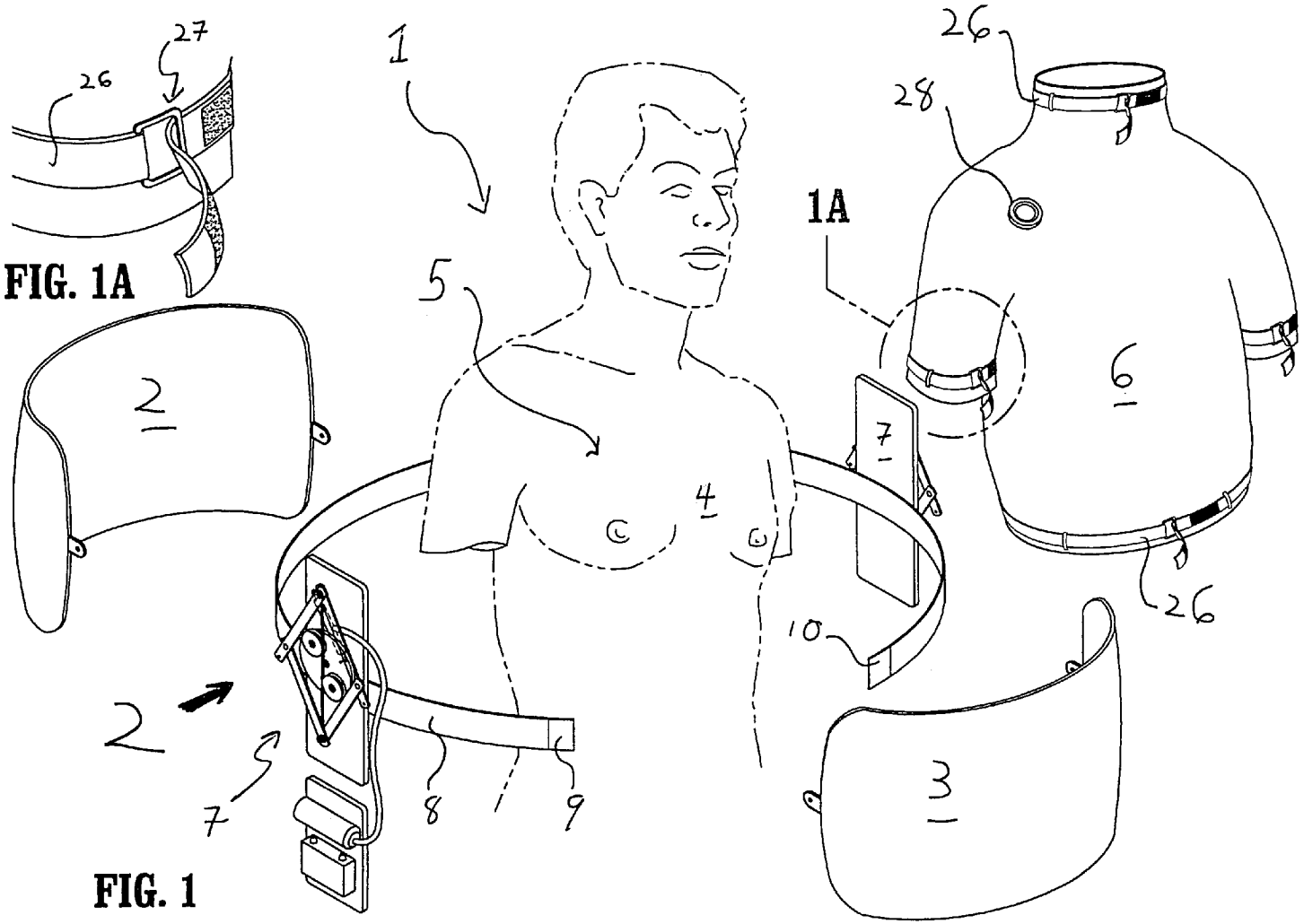
FIG. 1 is a schematic, exploded view of the inventive apparatus.
FIG. 1A is an enlarged view of encircled area 1A in FIG. 1.

Referring to the drawings in which analogous components are denoted by analogous reference numerals or characters, the inventive apparatus 1 for mechanically ventilating a patient has two components 2 and 3 arranged to reciprocally move towards and away from one another. These components are positioned about the torso 4 of a patient, i.e., the chest cavity 5, and secured within an outer elastic shell 6, e.g., a vest or shirt, which can be formed of any suitable material such as spandex, polyester, etc. A preferred elastic garment that functions especially well as an air-tight elastic shell 6 in accordance with the present invention is a Nike Dri-Fit short sleeve shirt composed of 82% polyester and 18% spandex. This shirt was coated on the outer surface thereof with a thin layer of General Electric clear Silicone II 100% Window and Door silicone sealant, manufactured by GE Sealants and Adhesives, Huntersville, N.C. 28078, to enhance air-tightness.

The movable components 2 and 3 themselves can be manufactured from any suitable material, e.g., fiberglass, lightweight plaster, or synthetic plastic such as polyethylene terephthalate, polyvinyl chloride, etc. An especially preferred material is hardened fiberglass created using a Bondo Home Solutions fiberglass mat manufactured by the Bondo Corporation (an RPM Company), 3700 Atlanta Industrial Parkway, N.W., Atlanta, Ga. 30331 and treated with Everciat (100498) automotive fiberglass resin and hardener, manufactured by Fibre Glass-Evercoat, a division of Illinois Tool Works, Inc. 660 CornelII Road, Cincinnati, Ohio 45242.

The flexible air-tight covering 6 is placed about the torso 4 of the patient, i.e., around the chest cavity 5, after the substantially rigid components 2 and 3 have been movably positioned about the torso 4 and chest cavity. Thereby, when components 2 and 3 move away from one another within the air-tight covering 6, negative pressure is generated within the air-tight covering 6 and influences the torso 4 and chest cavity 5 of the patient to cause the patient to draw air into the patient's lungs. Conversely, when the components 2 and 3 stop moving apart within the air-tight shell 6, the patient's natural exhalation mechanism takes over, allowing the patient to expel the air from within the patient's lungs.

Figure 2:
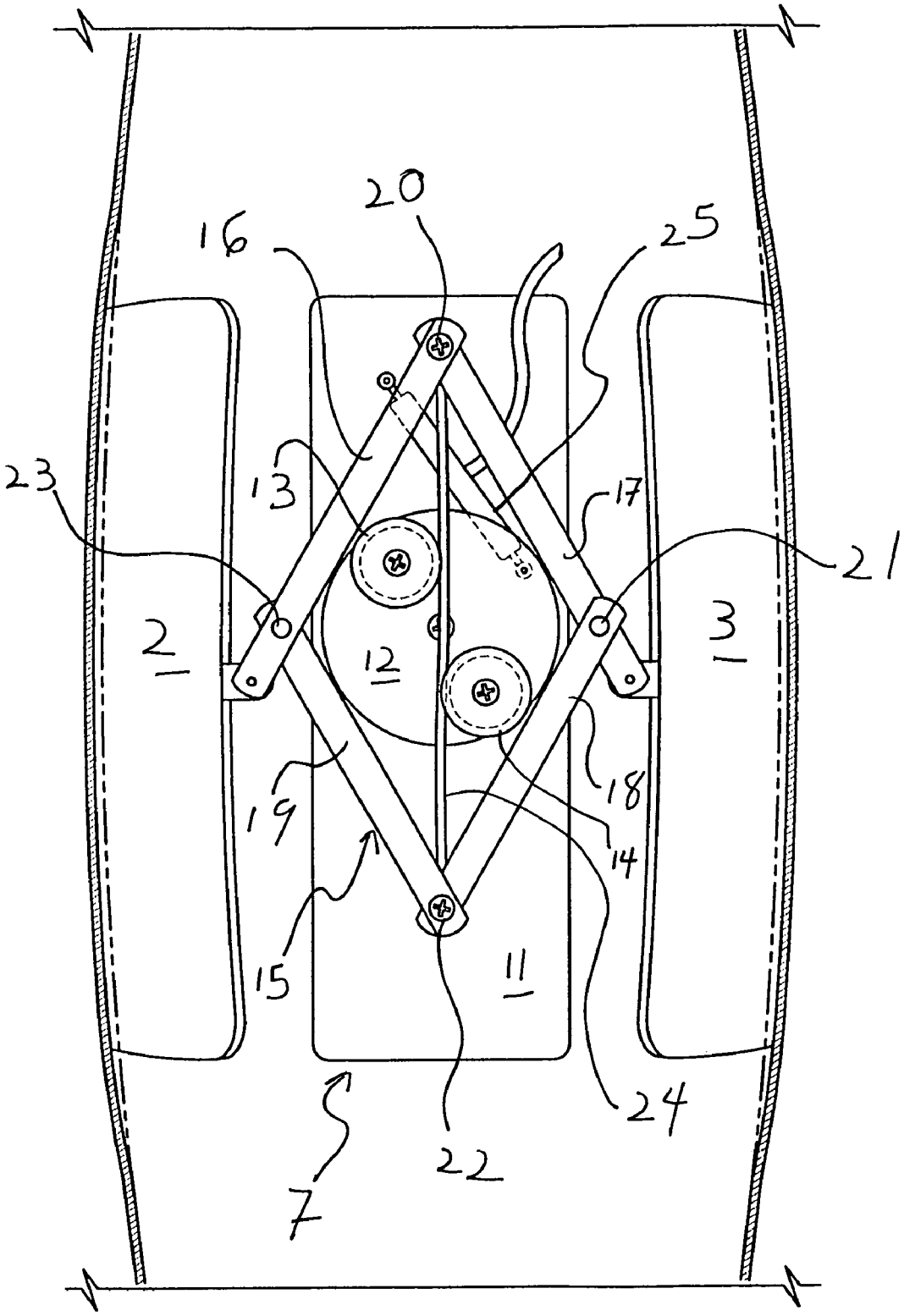
FIG. 2 is a plan view of a portion of the inventive apparatus from the direction of arrow 2 in FIG. 1.

As shown in FIG. 1, the inventive apparatus 1 comprises means 7 for movably coupling components 2 and 3 together such that they can reciprocally move towards and away from each other. This coupling means 7 can be mounted upon an elastic band 8 which is then secured around the patient's torso 4, e.g., by Velcro sections 9 and 10 at ends thereof. As best seen in FIG. 2, the coupling means 7 comprise a support 11 mounted upon the band 8, with a turntable 12 rotatably positioned upon the support 11 and, in turn, having two substantially cylindrical stops 13 and 14 mounted thereon. The two movable components 2 and 3 are coupled together through a pantograph linkage 15 taking the shape of a parallelogram in FIG. 2 comprising four links or sides 16, 17, 18, 19 rotatably coupled together about four respective pivot points 20, 21, 22, 23. As shown in FIG. 2, the components 2 and 3 are coupled to extensions of respective links 16 and 17 however the components can alternatively be coupled directly to the pivot points 21 and 23 within the purview of the present invention.

Figure 3:
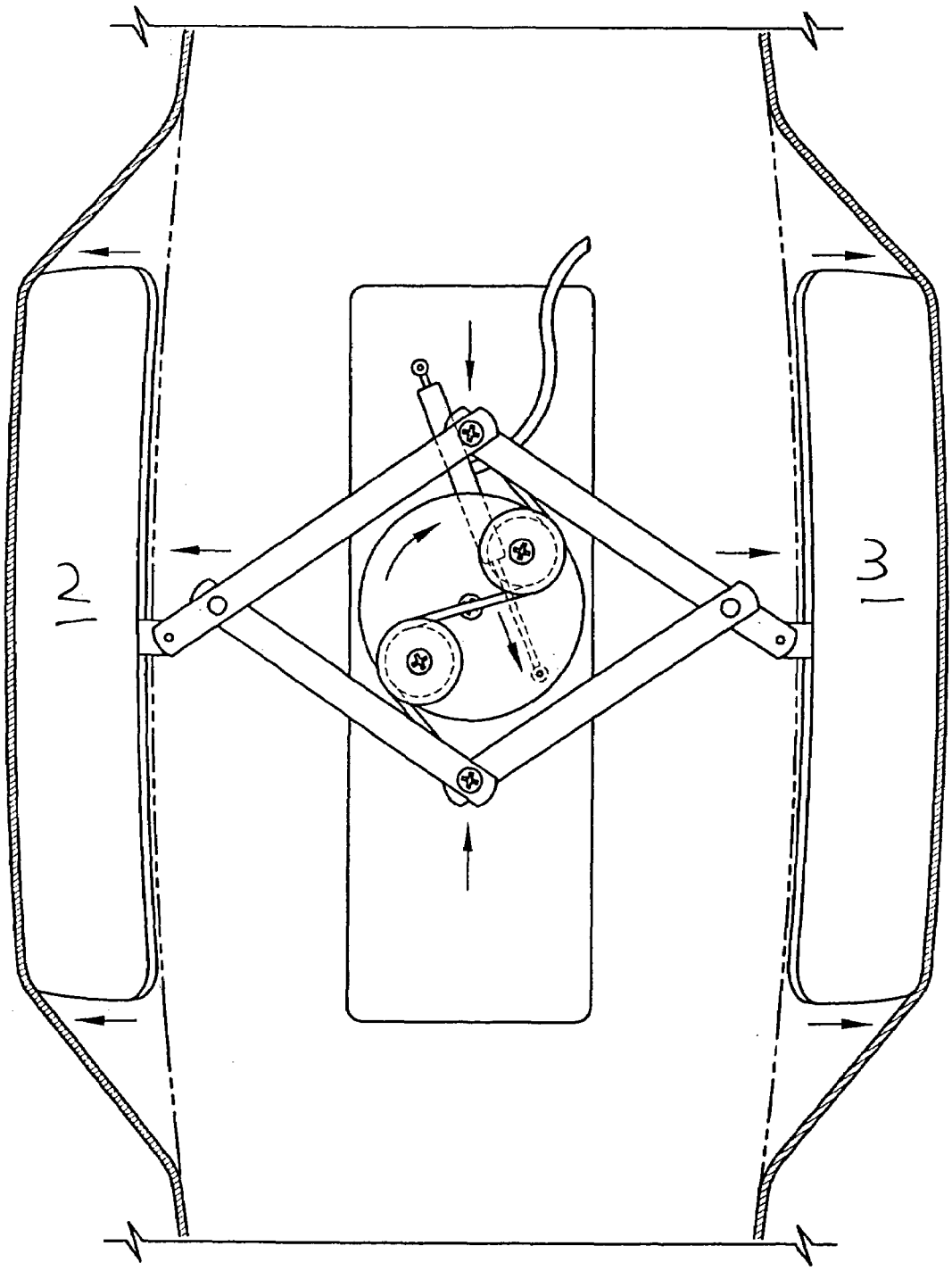
FIG. 3 is a plan view, similar to FIG. 2, and illustrating an oppositely-biased position of the inventive apparatus from the position shown in FIG. 2.

An untensioned member 24 is also mounted to the parallelogram linkage 15 to extend between two opposite pivot points 20 and 22 and straight between the stops 13 and 14 mounted upon the turntable, in unstressed state as shown in FIG. 2. Additionally, a pneumatic actuator 25 is coupled between the support 11 and turntable 12 as shown in FIGS. 2 and 3. When the pneumatic actuator rotates the turntable 12 with respect to the support 11 in a clockwise direction from FIG. 2 to FIG. 3, the space between the components 2 and 3 expands due to expansion of the pantograph linkage 15 and a negative pressure is generated within the elastic shell 6. At the same time, the member 24 is tensioned and twisted about the two stops 13 and 14 which rotate together with the turntable 12 as shown in FIG. 3, thereby enhancing a force biasing the parallelogram linkage to return to its untensioned state shown in FIG. 2.

Therefore, when pneumatic actuator 25 has expanded to maximum extension as shown, e.g., by the phantom lines in FIG. 3, the return biasing action of a spring within the pneumatic actuator 25 takes over to return the linkage to the unstressed state shown in FIG. 2, whereupon the pneumatic actuator retracts to initial position and once again begins the next cycle of expansion. Then, the elastic recoil of the patient's lungs causes spontaneous exhalation once the compressed air is no longer extending the pin of the actuator. This returns the linkage to the unstressed state in preparation for the next cycle of expansion.

Two such coupling means 7 have been illustrated in FIG. 1 although the inventive apparatus will effectively operate with just one such coupling mechanism as shown in FIGS. 2 and 3 and with the components coupled on opposite sides, e.g., by just a driven pantograph linkage. Although the embodiment illustrated in FIG. 1 shows the coupling means positioned within the outer shell 6, nevertheless such coupling means could easily be positioned outside the air-tight covering 6 and appropriately coupled to the components 2 and 3 within the covering 6 through openings provided in the covering 6. As denoted by the dotted lines in FIG. 1, the band 8 is initially positioned about the torso 4 of a patient. The support member 11 of the coupling means is conveniently secured to the band 8 either before or after the band 8 is positioned about the torso 4 of a patient.

Next, the components 2 and 3 are secured to respective extensions of the pantograph linkages 15, followed by positioning of the air-tight covering 6 securely about the torso of the patient, including the chest cavity. The neck, waist, and sleeve openings of the covering 6 are sealed by respective straps 26 and buckles 27 as shown in detail in FIG. 1A, to provide a secure air-tight enclosure within the covering 6. Additionally, a one-way check valve 28 is provided in the covering 6 to release air from within the sealed covering 6 and avoid undue build-up of air pressure therewithin.

Figure 4:
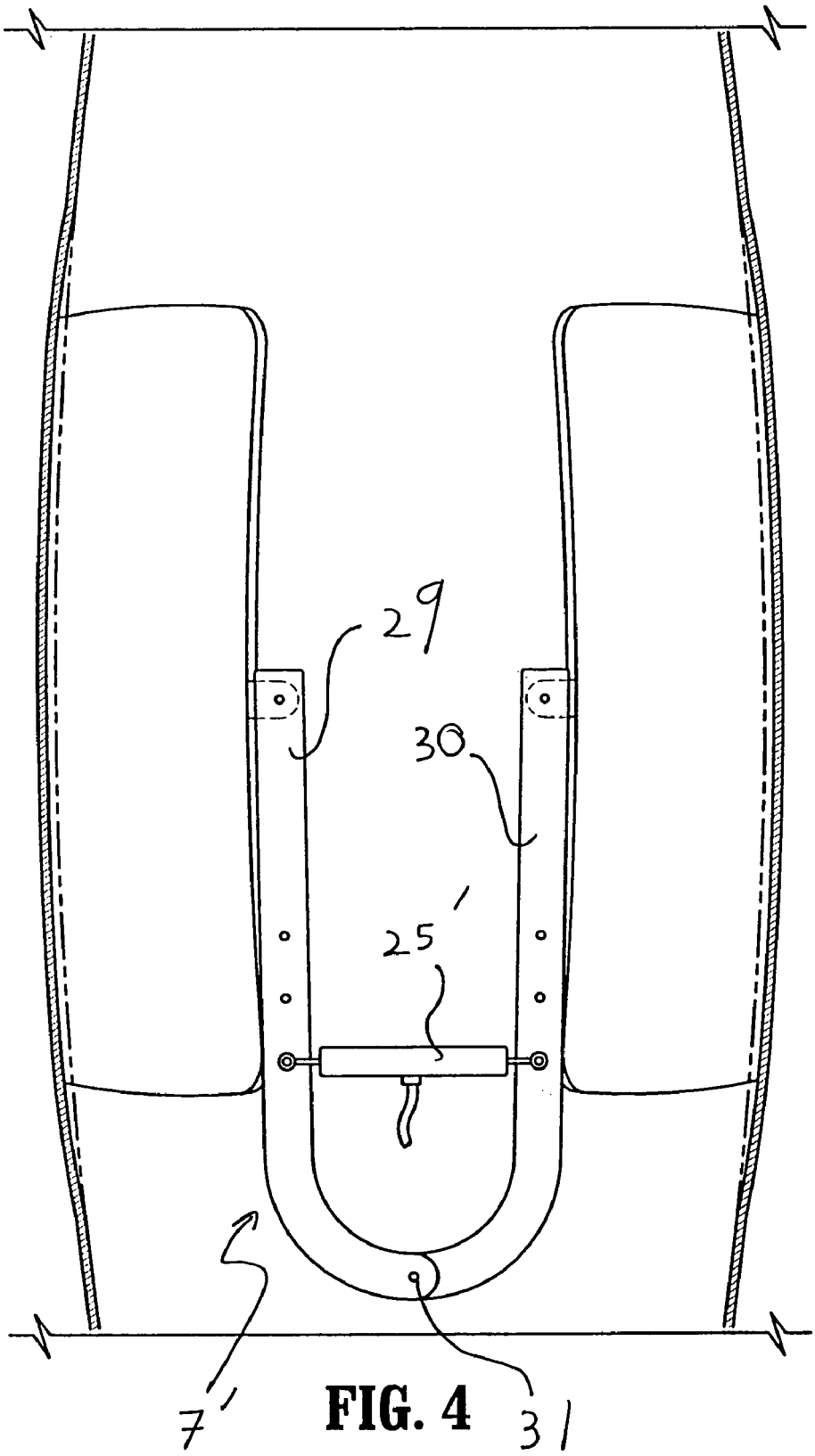
FIG. 4 is a plan view, similar to FIG. 2 and illustrating an alternative embodiment of the inventive apparatus.
Figure 5:
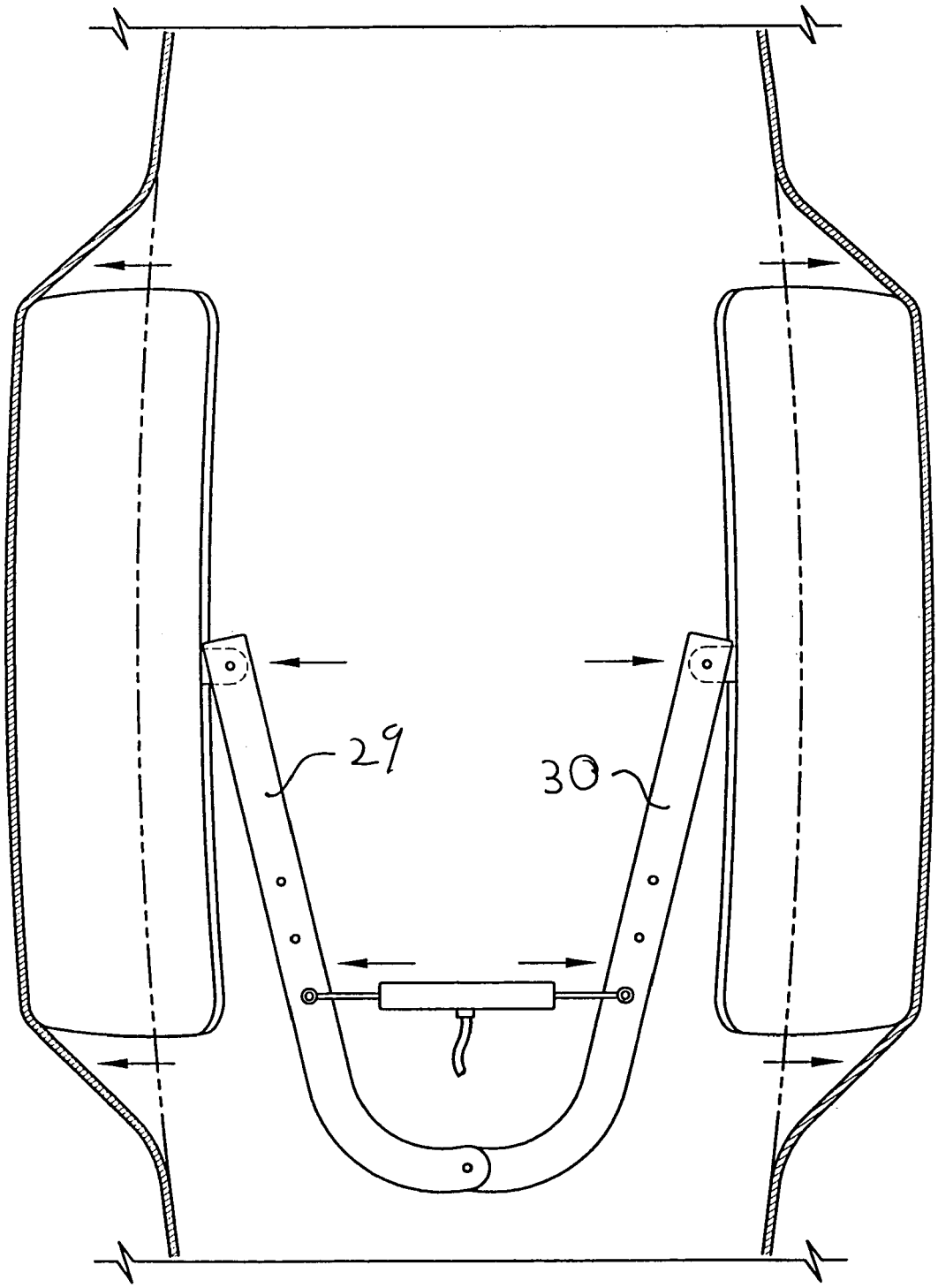
FIG. 5 is a plan view, similar to FIG. 3, and illustrating an oppositely-biased position of the inventive apparatus from the position shown in FIG. 4.

FIGS. 4 and 5 illustrate and alternative embodiment of the coupling means 7' which dispenses with the support plate 11 and turntable 12. More particularly, in this embodiment, the coupling means 7' comprises two members 29 and 30 forming a linkage substantially in the shape of a U or horseshoe and pivotally coupled together at a pivot point 31 situated substantially at the base of the U or horseshoe. A respective movable component 2 and 3 is coupled to a respective pivotal member 29 and 30. A pneumatic actuator 25' is provided similarly to the embodiment shown in FIGS. 2 and 3 but with the actuator 25' laterally coupled to the pivotal members 29 and 30 above the pivot point 31 as shown. Additionally, means (not shown) for biasing the pivotal members 29 and 30 towards the position shown in FIG. 4, e.g., a coil spring, can be provided. The remaining components of the inventive device are the same as shown in FIGS. 1-3.

The pneumatic actuator 25' operates to push the pivotal members 29 and 30 apart from one another to the position shown in FIG. 5 where the components 2 and 3 are also moved apart, hence creating the negative pressure within the air-tight covering 6. When the pneumatic actuator 25' reaches the point of maximum extension shown in FIG. 5, then the spring action within the pneumatic actuator takes over and biases the pivotal arms 29 and 30 back to the closer position shown in FIG. 4 where the cycle begins once again.

Figure 6:
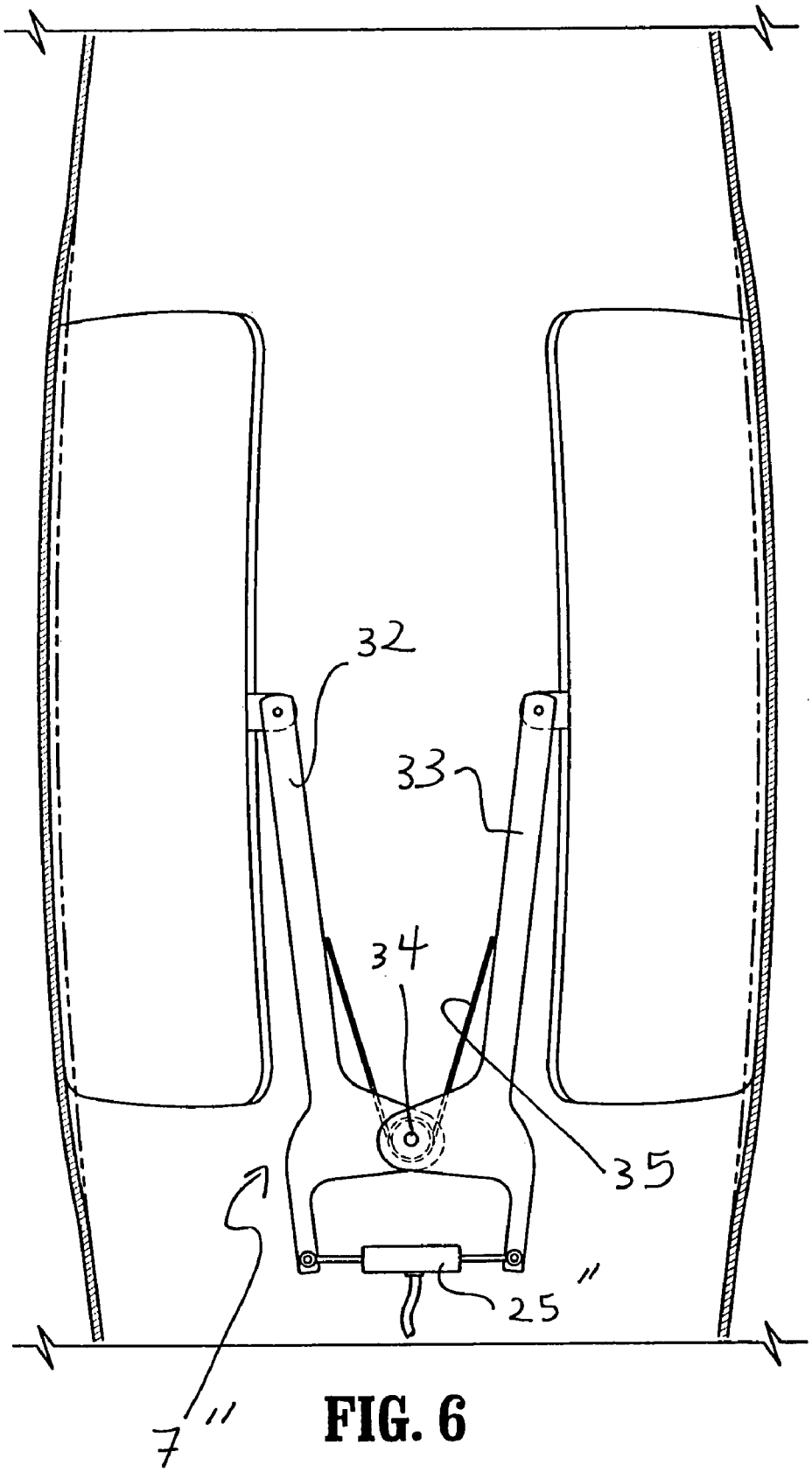
FIG. 6 is a plan view, similar to FIGS. 2 and 4, and illustrating another alternative embodiment of the inventive apparatus.
Figure 7:
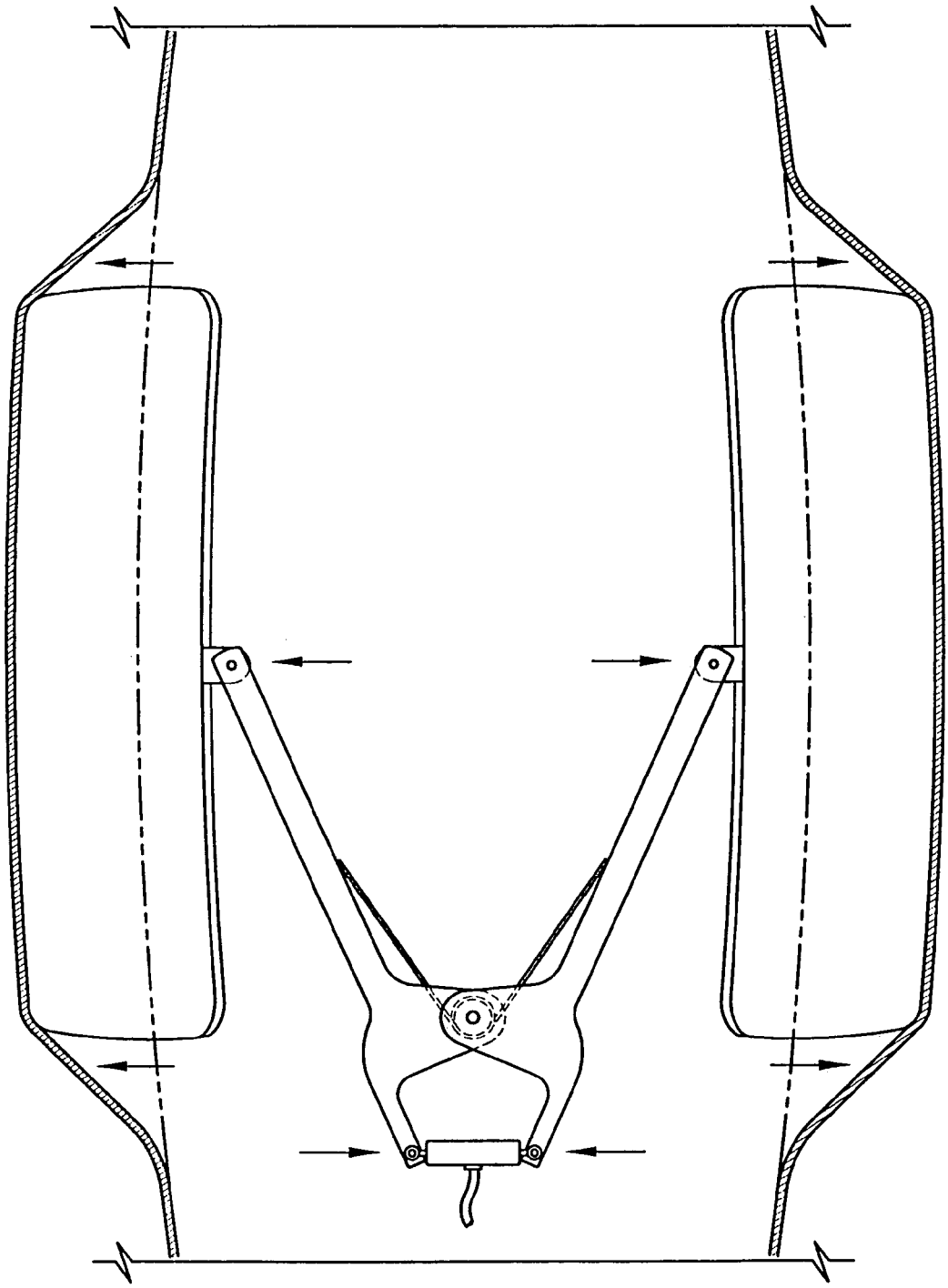
FIG. 7 is a plan view, similar to FIGS. 3 and 5, and illustrating an oppositely-biased position of the inventive apparatus from the position shown in FIG. 6.
Figure 9:
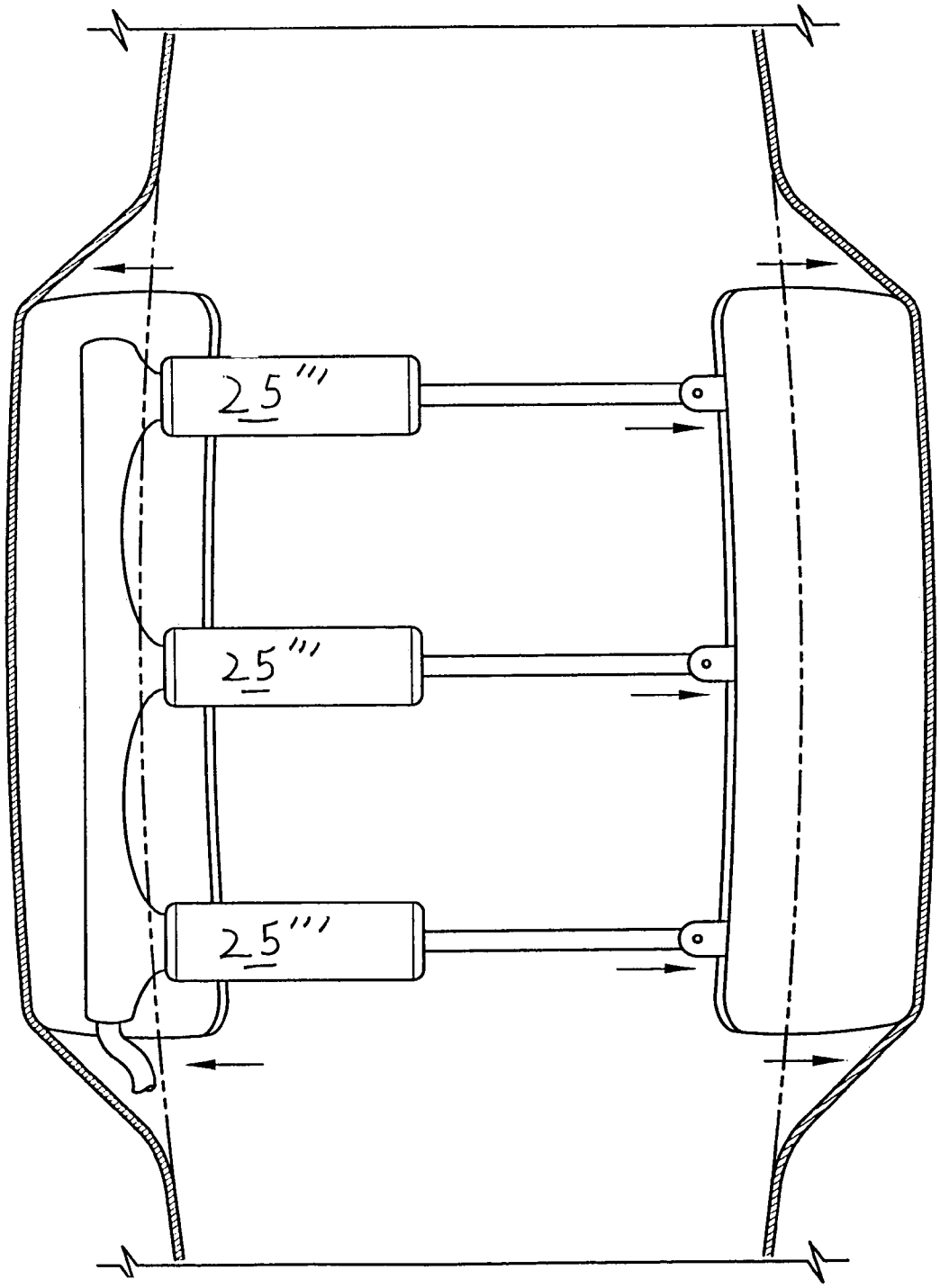

FIGS. 6 and 7 illustrate a further alternative embodiment of the coupling means 7" in the shape of a pincer, having two arms 32 and 33 coupled together about pivot point 34 intermediately positioned between ends of the arms 32 and 33 and with adjacent ends of the arms 32 and 33 coupled to the respective components 2 and 3 as illustrated. The pneumatic cylinder 25" is coupled to the opposite ends of the respective arms as shown, with the elastic member 35, e.g. a coil spring, wound about the pivot point 34 and coupled to the respective arms 32, 33.

In contrast to the previous two embodiments, expansion of the pneumatic actuator causes the ends of the arms 32, 33 respectively coupled to the components 2 and 3 to pivot towards one another and thereby move the components 2 and 3 towards one another and generate a positive pressure within the air-tight covering 6. When the pneumatic actuator 25" reaches its maximum expansion shown in FIG. 6, the force of the coil spring 35 takes over and biases the ends of the arms 32, 33 coupled to the components 2 and 3 away from one another to the position shown in FIG. 7, thereby generating the negative pressure within the air-tight covering 6.

In the embodiment shown in FIGS. 6 and 7, the mechanism still functions to create a negative pressure within the vest, causing the patient to inspire air into the lungs. However, in contrast to the previously-described embodiments, recoil of the coil spring 35 (and not the pneumatic actuator 25") explicitly generates the negative pressure within the vest 6, whereas active expansion of the pneumatic actuator 25" shown in FIG. 6 enhance the patient's exhalation.

Referring to FIG. 8, the components 2 and 3 can be coupled directly to a series of spring-loaded actuators 25''', 25''', 25''' illustrated in extended or expanded position. Compressed gas within these actuator tubes activates all these actuators simultaneously. In other respects, the mechanism of ventilating a patient operates analogously to the other illustrated embodiments supra.

Any suitable, commercially-available pneumatic actuator can be used as the pneumatic actuator 25 in the inventive apparatus. One such pneumatic actuator is the commercially-available HONEYWELL MP909D1201 providing maximum air pressure 30 psi, nominal spring range 3 to 8 psi and a stroke of 2.4 inches.

Therefore, the present apparatus constitutes a self-contained, portable ventilation system permitting patients using the same to remain fully mobile. Improved patient mobility will also improve respiratory mechanics and quality of life. The inventive apparatus, i.e., the rubberized covering 6, can be used either intermittently, or continuously throughout the day or night, and is always effective whether the patient is standing, sitting or lying down.

The preceding description of the present invention is merely exemplary and is not intended to limit the scope thereof in any way.

What is claimed is:

1. Apparatus for mechanically ventilating a patient, comprising two separate, substantially rigid components structured and arranged to be coupled to both simultaneously move and move towards and away from one another and one of said rigid components positioned adjacent a front or anterior of a torso of the patient and the other of said rigid components positioned adjacent a rear or posterior of the torso of the patient, on opposite sides of the torso of the patient, and a flexible, air-tight, elastic covering encapsulating both said components on all sides thereof and surrounding the torso when placed about the torso of the patient, such that when said components move away from one another within said air-tight, elastic covering, negative pressure is generated within said air-tight, elastic covering and influences the torso to cause the patient to draw air into the patient's lungs, and when said components no longer move away from one another, the patient's natural pulmonary elastic recoil expels the air from within the patient's lungs and, together with said air-tight, elastic covering returning to unstretched condition, causes the pressure within said air-tight, elastic covering to become positive and move said components together.

2. The apparatus of claim 1, wherein said components are movably coupled to each other to reciprocally move towards and away from one another.

3. The apparatus of claim 2, additionally comprising means for movably coupling said components together.

4. The apparatus of claim 3, wherein said means comprise two members substantially forming the shape of a U or horseshoe and pivotally coupled together about a pivot point positioned substantially at a base of the U or horseshoe, and with a respective component coupled to a respective pivotal member, such that pivoting of the members with respect to one another about said pivot point reciprocally moves said components towards and away from one another.

5. The apparatus of claim 4, wherein said means additionally comprise a pneumatic actuator coupled to said pivotal members to pivot said members away from one another about said pivot point.

6. The apparatus of claim 3, wherein said means are in the form of a pincer comprising two arms pivotally coupled together about a pivot point intermediately positioned between ends of each said arm.

7. The apparatus of claim 6, wherein said components are each coupled to a respective arm on the same side of said pivot point such that pivoting of said arms about said pivot point moves said components towards and away from one another.

8. The apparatus of claim 7, additionally comprising an elastic member coupled to said arms and wrapped about said pivot point such that when said arms are pivoted towards one another, said elastic member biases said arms to pivot away from one another.

9. The apparatus of claim 8, wherein said means additionally comprise a pneumatic actuator coupled to said pivotal arms to bias the same towards one another.

10. The apparatus of claim 1, wherein said air-tight, elastic covering and components are structured and arranged with respect to one another to expand and contract said air-tight, elastic covering in anterior and posterior relation to the patient.

11. An apparatus for mechanically ventilating a patient, comprising two separate, substantially rigid components structured and arranged to be movably coupled with respect to one another, a flexible, air-tight, elastic covering structured and arranged to cover both said components when placed about a torso of the patient, and means for movably coupling said components together, wherein said components are movably coupled to each other to reciprocally move towards and away from one another, and said means are a pantograph linkage coupling said two components together, such that when said components move away from one another within said air-tight, elastic covering, negative pressure is generated within said air-tight, elastic covering and influences the torso to cause the patient to draw air into the patient's lungs, and when said components no longer move away from one another, the patient's natural pulmonary elastic recoil expels the air from within the patient's lungs and, together with said air-tight, elastic covering returning to unstretched condition, causes the pressure within said air-tight, elastic covering to become positive and move said components together.

12. The apparatus of claim 11, wherein said pantograph linkage comprise the shape of a parallelogram having four sides pivotally coupled together about four respective pivot points such that normal distance between opposite sides of the parallelogram can vary.

13. The apparatus of claim 12, wherein said components are coupled to a respective side of said parallelogram for reciprocal movement therewith.

14. The apparatus of claim 12, wherein said components are movably connected to pivot points of said parallelogram to reciprocally move towards and away from one another.

15. The apparatus of claim 12, wherein said means additionally comprise a rotatable turntable situated within said parallelogram, member strung across said turntable between opposite pivot points of said parallelogram, and a pair of stops mounted upon said turntable, such that in unstressed state, said strung member extends straight across said turntable, and when said turntable rotates, said strung member is twisted and tensioned about said stops.

16. The apparatus of claim 15, wherein said means additionally comprise a support member upon which said turntable is rotatably mounted, and a pneumatic actuator coupled to both said turntable and support to bias said turntable to stressed state of said strung member being twisted about said stops.

* * * * *